US009803354B1

(12) United States Patent
Francies, III

(10) Patent No.: US 9,803,354 B1
(45) Date of Patent: Oct. 31, 2017

(54) ANCHOR FOR CONCRETE CONSTRUCTION

(71) Applicant: MAESTRO INTERNATIONAL, LLC, Lithia, FL (US)

(72) Inventor: Sidney E. Francies, III, Lithia, FL (US)

(73) Assignee: MAESTRO INTERNATIONAL, LLC, Lithia, FL (US)

( * ) Notice: Subject to any disclaimer, the term of this patent is extended or adjusted under 35 U.S.C. 154(b) by 0 days.

(21) Appl. No.: 15/083,347

(22) Filed: Mar. 29, 2016

Related U.S. Application Data

(60) Provisional application No. 62/142,095, filed on Apr. 2, 2015.

(51) Int. Cl.
*E04B 1/41* (2006.01)
*E04G 21/14* (2006.01)

(52) U.S. Cl.
CPC ..... *E04B 1/41* (2013.01); *E04B 1/4107* (2013.01); *E04B 2001/4192* (2013.01); *E04G 21/142* (2013.01)

(58) Field of Classification Search
None
See application file for complete search history.

(56) References Cited

U.S. PATENT DOCUMENTS 1,768,246 A * 6/1930 Gaddis ..... E04B 1/4107 52/699
1,929,835 A * 10/1933 Awbrey ..... E04B 1/4107 52/379
1,929,836 A * 10/1933 Brown ..... 134/167 R
2,163,446 A * 6/1939 Heckman ..... E04B 1/4135 411/399
2,780,936 A * 2/1957 Hillberg ..... E04B 1/4107 52/379
7,654,057 B2 * 2/2010 Zambelli ..... E04B 1/4107 411/82
7,814,710 B2 * 10/2010 Foglia ..... E04B 1/4107 52/709
D651,324 S * 12/2011 You ..... D25/133
8,635,832 B2 * 1/2014 Heudorfer ..... E04B 1/4107 52/704
8,978,326 B2 * 3/2015 Hohmann, Jr. ..... E04B 1/4114 52/238.1
2004/0040251 A1 * 3/2004 Mok ..... E04B 1/4107 52/719
2010/0170185 A1 * 7/2010 Birnbaum ..... E04B 1/4107 52/699
2010/0181790 A1 * 7/2010 Fernandez Fernandez ..... B66C 1/666 594/89
2011/0138735 A1 * 6/2011 Foley ..... E04B 1/4114 52/699

(Continued)

*Primary Examiner* — Joshua J Michener
*Assistant Examiner* — Kyle J. Walraed-Sullivan
(74) *Attorney, Agent, or Firm* — McGarry Bair PC

(57) ABSTRACT

An apparatus for mounting construction or masonry materials to a concrete cast including an anchor. The anchor includes angled walls at the base and sidewalls terminating at an angled flange. The flange defines a gap for inserting one or more fasteners for mounting the concrete cast to another structural element with the fastener. The angled walls and flanges provide for increased load capabilities for the anchor as well as reduced bending, cracking, and shearing.

14 Claims, 14 Drawing Sheets

(56) References Cited

U.S. PATENT DOCUMENTS

| | | | | |
|---|---|---|---|---|
| 2011/0283654 | A1* | 11/2011 | Pol | B21D 28/24 52/710 |
| 2012/0110943 | A1* | 5/2012 | Ally | E04B 1/4128 52/582.1 |
| 2013/0248671 | A1* | 9/2013 | Schleiermacher | E04B 1/41 248/309.1 |
| 2014/0069048 | A1* | 3/2014 | Ally | E04B 1/41 52/699 |
| 2014/0318074 | A1* | 10/2014 | Heudorfer | E04B 1/4107 52/710 |

* cited by examiner

ANCHOR FOR CONCRETE CONSTRUCTION

CROSS-REFERENCE TO RELATED APPLICATION

This application claims priority from U.S. Provisional Application No. 62/142,095 filed on Apr. 2, 2015, entitled Anchor for Concrete Construction, which is incorporated herein by reference in its entirety.

BACKGROUND OF THE INVENTION

Typical anchors set in concrete casts have one or more tabs to secure the anchor within the concrete, or provide a hole in the tabs for utilizing a bolt to secure the anchor to the concrete or the overall structure. The tabs are commonly bent at a ninety-degree angle relative to the sides of the anchor where they are initially machined. Bolts are inserted within holes in the tabs to bolt the anchor to the building structure. The tabs necessarily carry the load of the attached construction materials. Bending the tabs may cause a premature shear cone to start at the top of the tab. Additionally, the tab may bend further, causing premature cracking before the bolts take a load. Furthermore, tabs common in the industry are relatively thin, increasing the possibility of undesired bending, cracking, or shearing.

SUMMARY OF THE INVENTION

A first aspect of the invention relates to a concrete anchor including a base including two planar base walls intersecting one another to define a dividing line extending along the base with the base walls defining an obtuse angle between one another. The anchor further includes two sidewalls extending from the base walls in the direction of the obtuse angle and two flanges extending from the sidewalls toward one another to define a channel between the two flanges. The combination of the base, the sidewalls, and the flanges defines an interior for the anchor permitting the insertion of a fastener for mounting at the anchor.

In another aspect of the invention, a concrete mounting anchor includes a base including a first base wall and a second base wall intersecting one another to define an dividing line extending along the base with the base walls defining an obtuse angle between one another, with the first base wall being longer than the second base wall. The anchor further includes two sidewalls extending from the base walls with a first sidewall being longer than a second sidewall and two flanges extending from the sidewalls toward each other to define a channel between the flanges, with a first flange being longer than a second flange.

In yet another aspect of the invention, a concrete casting anchor includes a v-shaped base wall, two sidewalls extending from the base wall defining two open ends of the anchor, and two flanges extending from the sidewalls opposite of the base wall defining a channel between the flanges. The anchor further includes at least one cap wherein the at least one cap encloses the open ends and the channel to define an interior for the anchor.

DESCRIPTION OF THE PREFERRED EMBODIMENT

It should be understood that the invention relates to an anchor for mounting and interconnecting structural components, often related to masonry and building constructions. It should be understood that while the invention is described in relation to an anchor being cast in concrete, it may have similar applicability in other construction implementations related to construction, masonry, casting, or similar endeavors.

Figure 1:
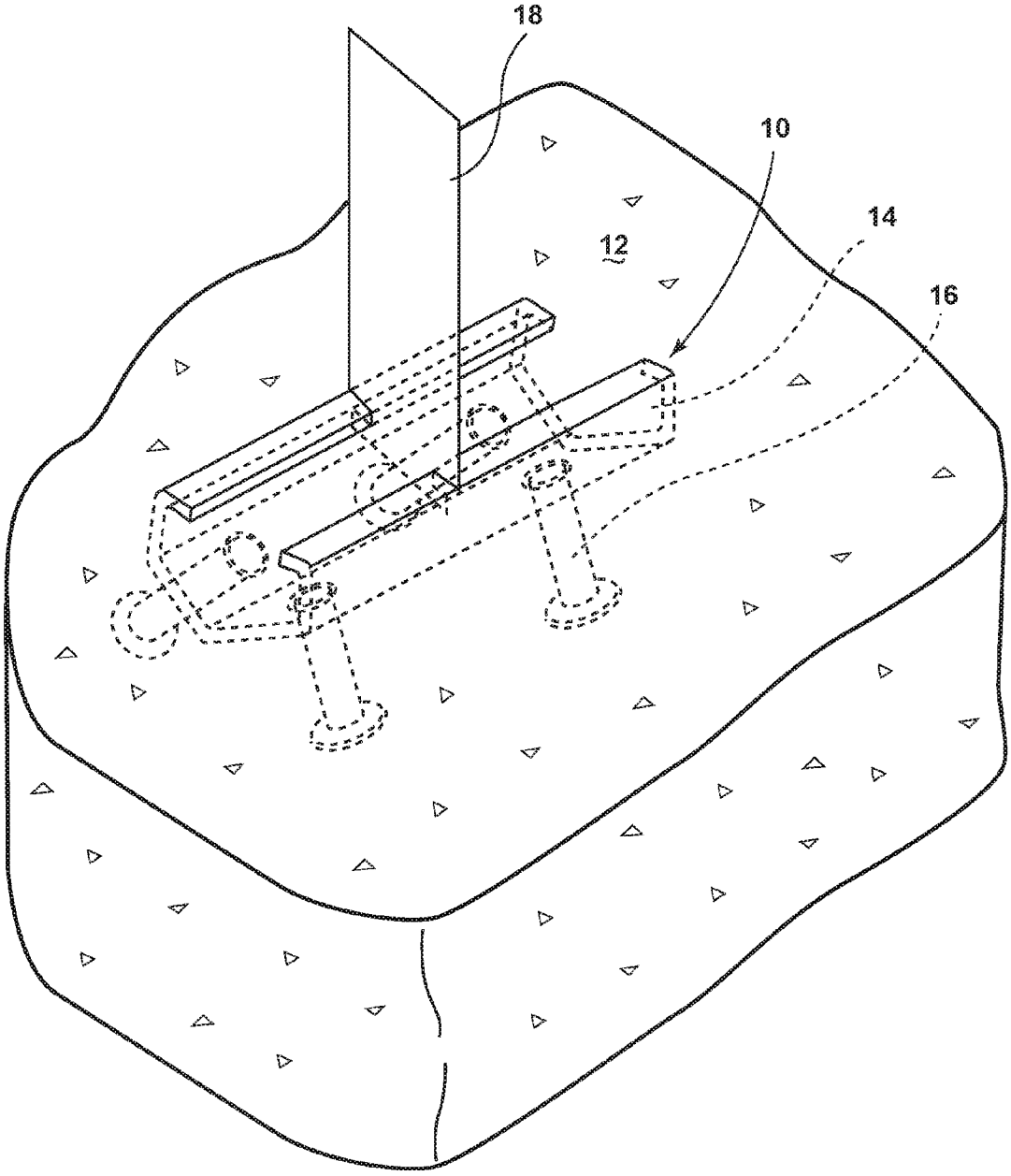
FIG. 1 is a perspective view of an anchor fixed in concrete, having a strap extending therefrom.

Referring now to FIG. 1, an anchor 10 is illustrated disposed in a concrete cast 12. The anchor includes an anchor body 14 having four bolts 16 mounted to the anchor body 14 for securing the anchor 10 to the concrete cast 12 or to another building structural element, such as a beam or girder in non-limiting examples. A fastener 18, illustrated as a strap, can mount to the anchor body 14. Such a fastener 18 can be used to mount a separate structural element (not shown) to the concrete cast 12 at the anchor 10. For example, the fastener 18 can weld to a metal beam disposed orthogonal to the concrete cast 12. As such, the anchor 10 provides for facilitating the mounting and interconnecting of structural construction elements, particularly cast concrete. It should be understood that while the fastener 18 is illustrated and described in relation to a strap, the fastener is not so limited and can be a bolt, threaded fastener, or other similar fastener in non-limiting examples. Such a fastener 18 can slidably or rotatably insert at the anchor 10, thread, screw, weld, or otherwise mount to the anchor 10. The anchor 10 is preferably made of high-strength, low-corrosion metal or can be coated with a non-corrosive finish.

Figure 2:
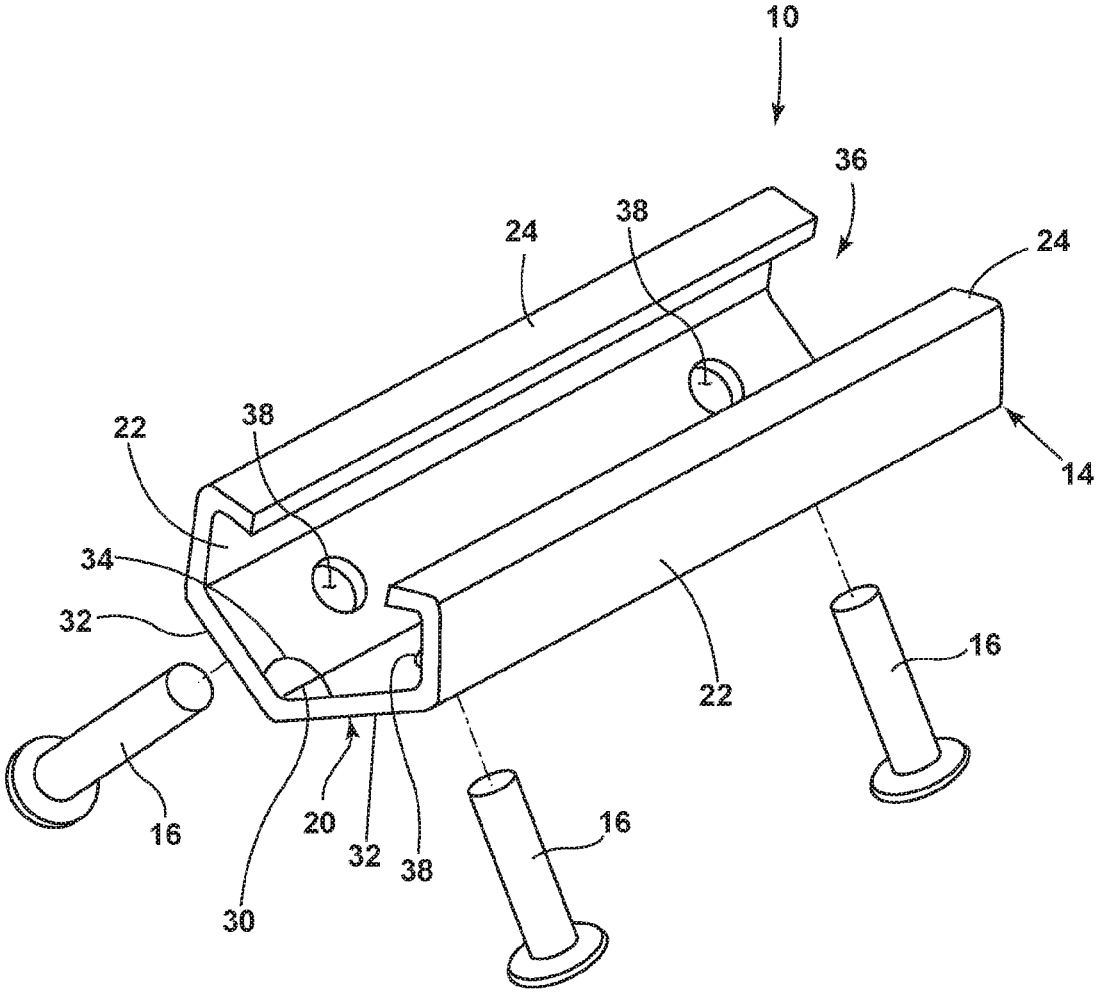
FIG. 2 is a perspective view the anchor of FIG. 1 including mounting bolts exploded form the anchor.

Referring now to FIG. 2, the anchor 10 is removed from the concrete cast and includes bolts 16 exploded from the anchor 10. The anchor body 14 is a single integral member, which can be formed, for example, by extrusion or casting in non-limiting examples. The anchor body 14 can include a base 20, including sidewalls 22 extending from the base 20 and having flanges 24 extending from the sidewalls 22.

The base 20 can be v-shaped, defining a dividing line 30 extending along the length of the base 20 to separate the base into two base walls 32 intersecting one another at the dividing line 30. The v-shape of the base 20 orients the base walls 32 at an obtuse angle 34 relative to one another, being greater than ninety degrees, but less than 180 degrees. The sidewalls 22 extend from the base 20 being disposed parallel to the dividing line 30, extending from the side of the base 20 defining the obtuse angle 34. The flanges 24 extend from sidewalls 22 toward another, opposite of where the sidewalls 22 mount to the base 20. The flanges 24 extend only partially toward one another, defining a gap 36 between the flanges 24.

The base 20 can further include one or more apertures or holes 38 sized to receive the insertion of complementary bolts 16. It should be understood that while it is illustrated and described as having two holes 38 on each base wall 32, each base wall 32 can have any number of holes 38, being equal to or unequal to the other base wall 32, and can be arranged in a symmetric or asymmetric manner as may be desirable.

Figure 3:
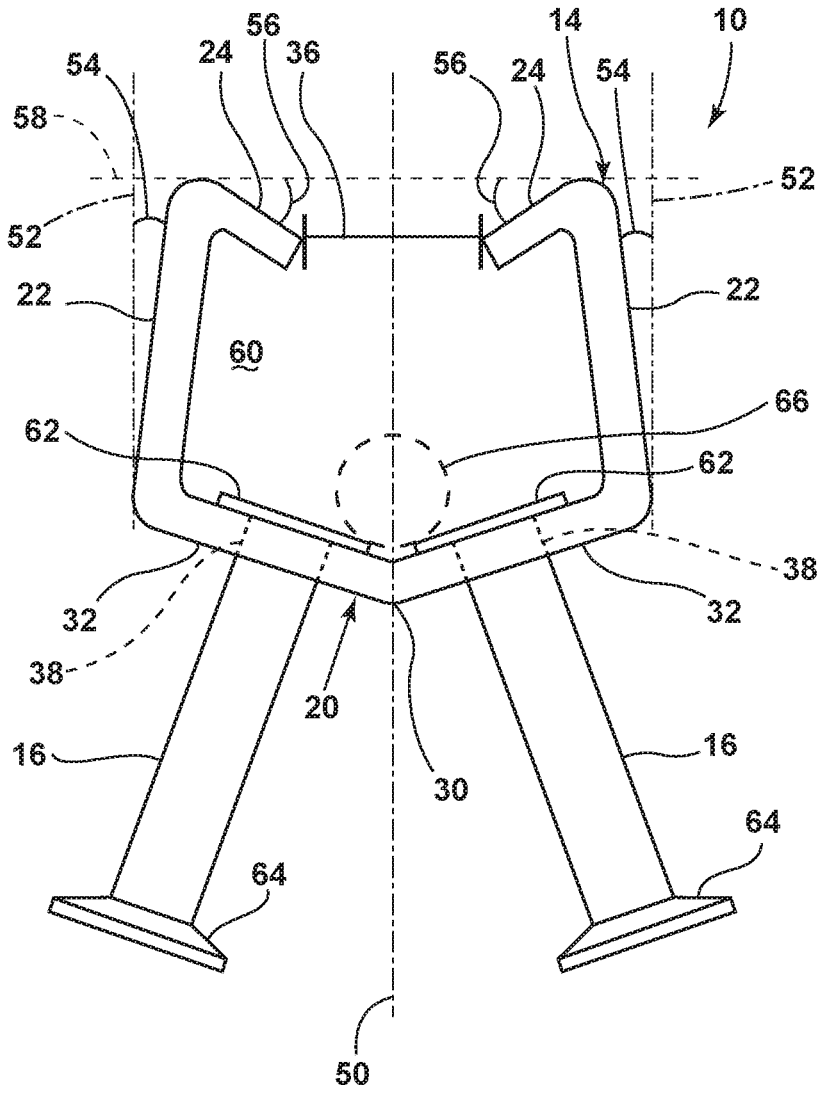
FIG. 3 is side view of the anchor of FIG. 1 having the bolts mounted within the anchor.

Referring now to FIG. 3, a side profile view of the base illustrates the shape of the anchor body 14. The anchor 10 can be symmetric about a vertical centerline 50 intersecting the dividing line 30. The sidewalls 22 can be offset from vertical axes 52, parallel to the vertical centerline 50, by a wall angle 54. The wall angle 54 can be between 5 degrees and 30 degrees, while wider angles are contemplated. As such, the sidewalls 22 are angled toward one another extending from the base 20. Similarly, the flanges 24 can be disposed at a flange angle 56 relative to a horizontal axis 58, disposed perpendicular to the centerline 50. The flange angle 56 can be between 5 degrees and 45 degrees, while wider angles are contemplated. As such the flanges 24 can be angled toward the base 20. The combination of the base 20, the sidewalls 22, and flanges 24 define an interior 60 for the anchor 10.

The bolts 16 are installed within the holes 38, extending from the base 20. The bolts 16 further include a head 62 and a foot 64. The bolt 16 can be pre-formed with the foot 64, but without the head 62. Alternatively, the foot 64 can be forged or welded onto the bolt 16. Without the head 62, the bolts 16 can be inserted into the holes 38. After insertion, the head 62 can be formed to secure the bolt within the hole 38 by any known method, such as tapping or swaging the end of the bolt 16, or by welding the head 62 onto the bolt 16 in non-limiting examples.

Optionally, a wire strand, such as rebar 66, for example, can be run through anchor 10 along the dividing line 30 to further secure the anchor 10 within the concrete 12 or provide additional support for a structural element connected at the anchor 10. The rebar 66 can be run through the anchor 10 prior to the pouring of the concrete into the cast.

Figure 4:
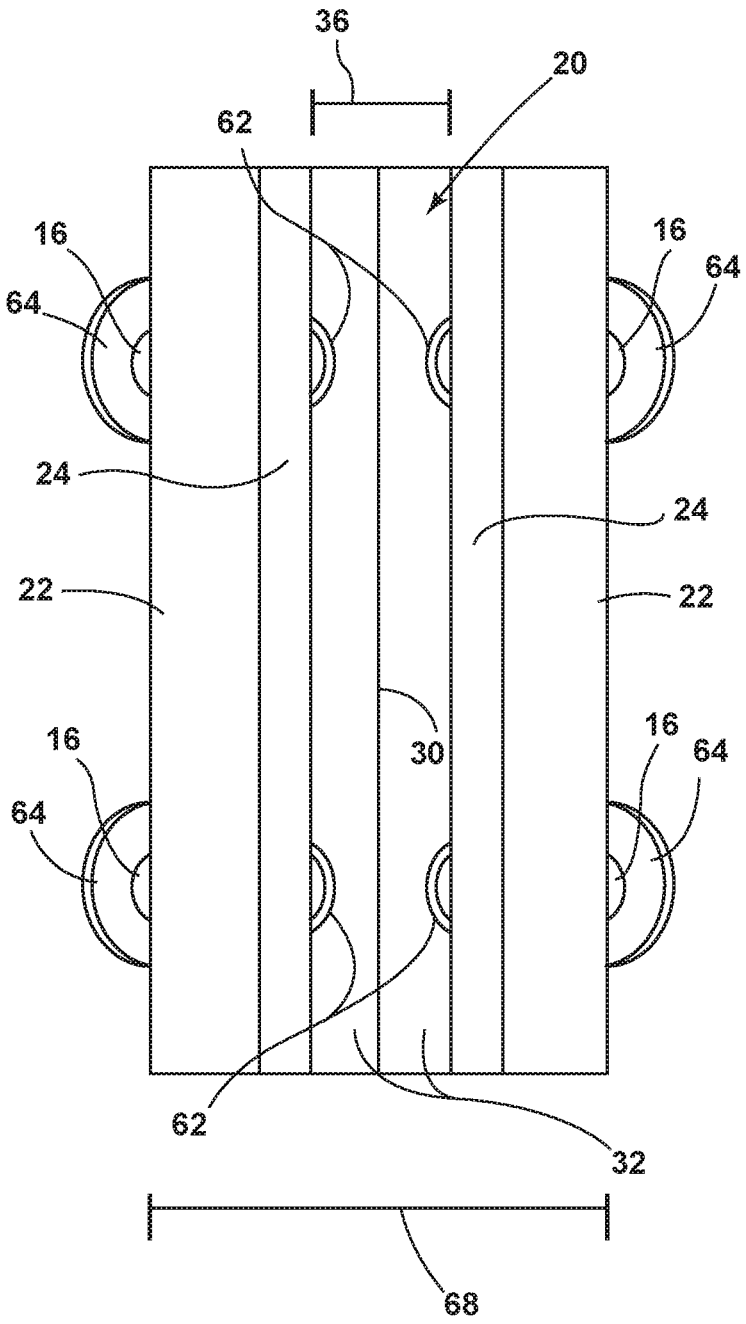
FIG. 4 is top view of the anchor of FIG. 3

Referring now to FIG. 4, the extension of the sidewalls 22 and the flanges 24 over the base 20 can be best appreciated. The base 20 provides a maximum width 68 for the anchor 10, having the sidewalls 22 and the flanges 24 extending inwardly toward the dividing line 30 to define the gap 36.

It should be appreciated that the bolts as shown are exemplary. The number, length, and position of the bolts is exemplary of one implementation, and can be altered based upon the particular anchor 10.

It should be understood that the orientation of the base 20, sidewalls 22, and flanges 24, such as defining the obtuse angle 34, the angled sidewalls angle 22, and the angled flanges 24, all provide for improved load bearing capability of the anchor 10. A widened angle on the bolts 16 can increase the load borne by the bolts 16 and that the anchor 10 can support. In a preferred embodiment, the bolts 16 are situated toward the outer edge of the base 20 near the sidewalls 22. Situating the bolts 16 close to the sidewalls 22 provides a more direct transfer of tension loads to the bolts 16 from the flanges 24. Furthermore, the angled disposition of the bolts 16 provides for reduced bending, cracking, and shearing of the bolts when supporting said loads.

Figure 5:
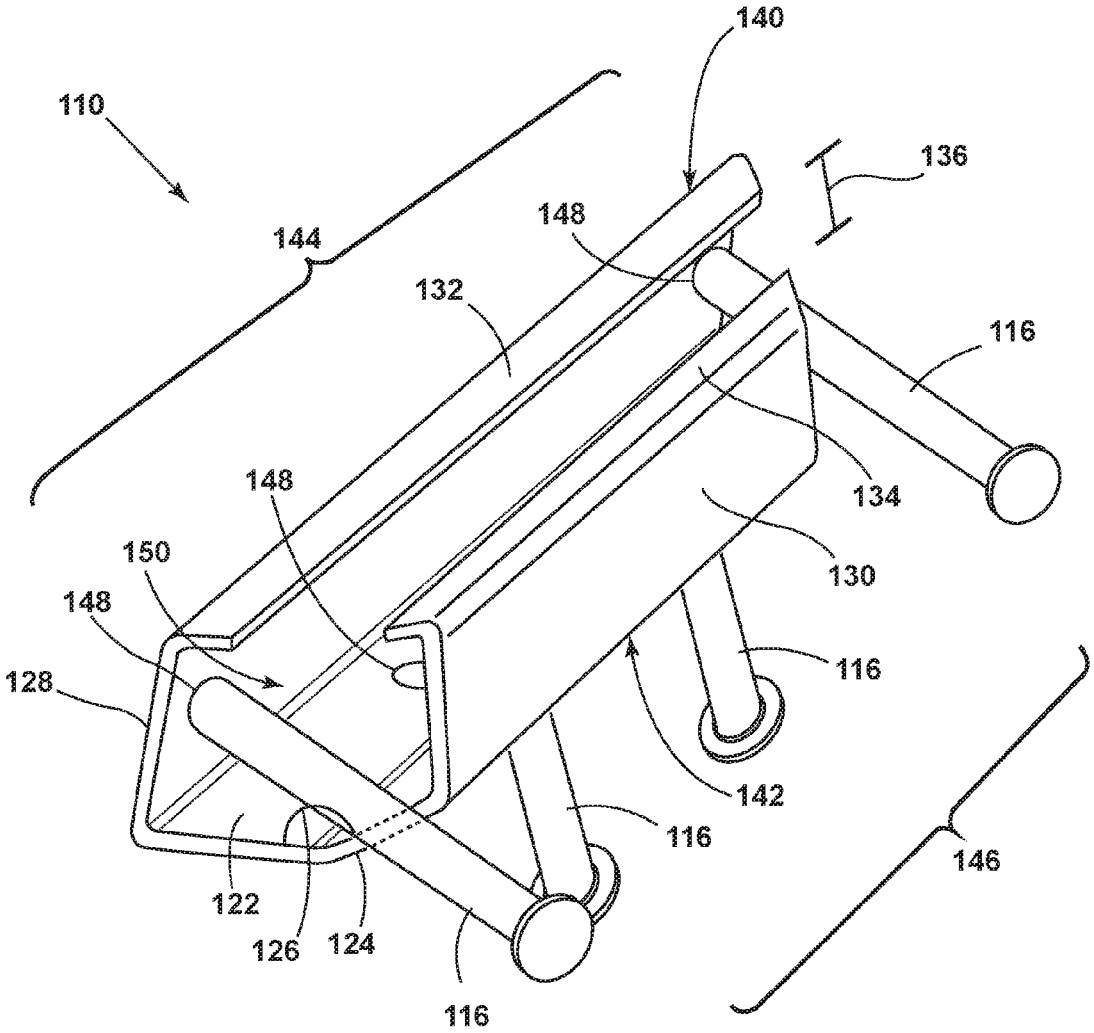
FIG. 5 is a perspective view of an asymmetric anchor according to a second embodiment of the invention, having bolts mounted within the anchor.

Referring now to FIG. 5, an anchor 110 is illustrated according to a second embodiment of the invention. The anchor 110 includes a base 120 having a first base wall 122 and a second base wall 124, with the first base wall 122 being longer than the second base wall 124. The base 120 forms a v-shape, similar to the base 20 of the first embodiment shown in FIG. 1, defining an obtuse angle 126 between the first and second base walls 120, 122. The anchor 110 further includes a first sidewall 128 and a second sidewall 130, with the first sidewall 128 being longer than the second sidewall 130. The first sidewall 128 extends from the first base wall 122 and the second sidewall 130 extends from the second base wall 124. Further still, the anchor 110 includes a first flange 132 and a second flange 134, with the first flange 132 being longer than the second flange 134. The first flange 132 can extend from the first sidewall 128 and the second flange 134 can extend from the second sidewall 130. The flanges 132, 134 can be spaced from one another to define a gap 136 between the flanges 132, 134.

Thus, the anchor 110 can define a long side 140 and a short side 142, with the long side 140 including the first base wall 120, the first sidewall 128, and the first flange 132 and the short side 142 including the second base wall 122, the second sidewall 130, and the second flange 134. The long side 140 can have a first length 144 and the short side can have a second length 146. The combination of the base 120, the sidewalls 128, 130 and the flanges 132, 134 can define an interior 150 for the anchor 110.

Additionally, the anchor 110 can include one or more holes 148. The holes 148 can be disposed along the base 120 or within the sidewalls 128, 130. The holes 148 can be shaped to receive the insertion of a fastener such as a bolt 116 for mounting the anchor 110 within a concrete cast, or for mounting the anchor 110 to another structure or structural element.

In the example where the bolts 116 are disposed within the sidewall 128, the difference between the first length 144 and the second length 146 can be great enough to permit sliding movement of the bolt 116 through the hole 148 without contacting the opposing sidewall 130.

Figure 6:
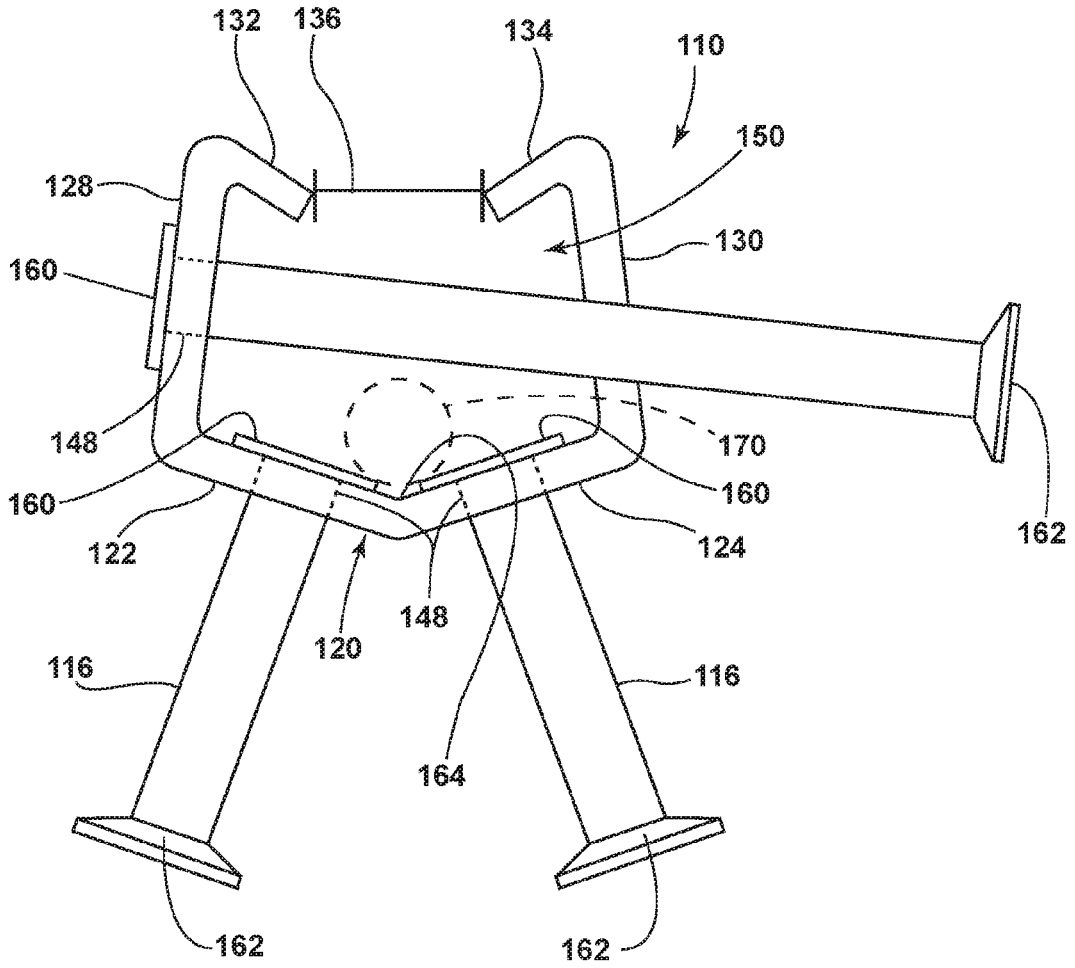
FIG. 6 is a front side view of the anchor of FIG. 5.

Referring now to FIG. 6, a side view of the anchor 110 illustrates a profile for the asymmetric anchor 110 similar to that of the symmetric anchor 10 shown in FIG. 3. With an asymmetric anchor 110, a bolt 116 can be utilized in the sidewall 128 and extend beyond the opposing sidewall 130 in a direction somewhat orthogonal to the disposition of the bolts 116 mounted in the base 120. Each bolt 116 can include a head 160 and a foot 162. The head 160 can be disposed in the interior 150 of the anchor 110, or can be external of the anchor 110, such as in the case of the bolt 116 extending through the sidewall 128. The bolt 116 can be machined including the foot 162, while the head 160 can be mounted to the bolt 116 during installation, or formed from the bolt 116, such as by welding, swaging, tapping, or any other method in non-limiting examples.

Similar to the symmetric anchor 10 of FIG. 3, the asymmetric anchor 110 includes the base 120 having the dividing line 164 to define the obtuse angle 126 for the base 120. The dividing line 164 can support or align a tensioned wire running through the middle of the anchor 110, such as rebar 170 in one non-limiting example.

Figure 7:
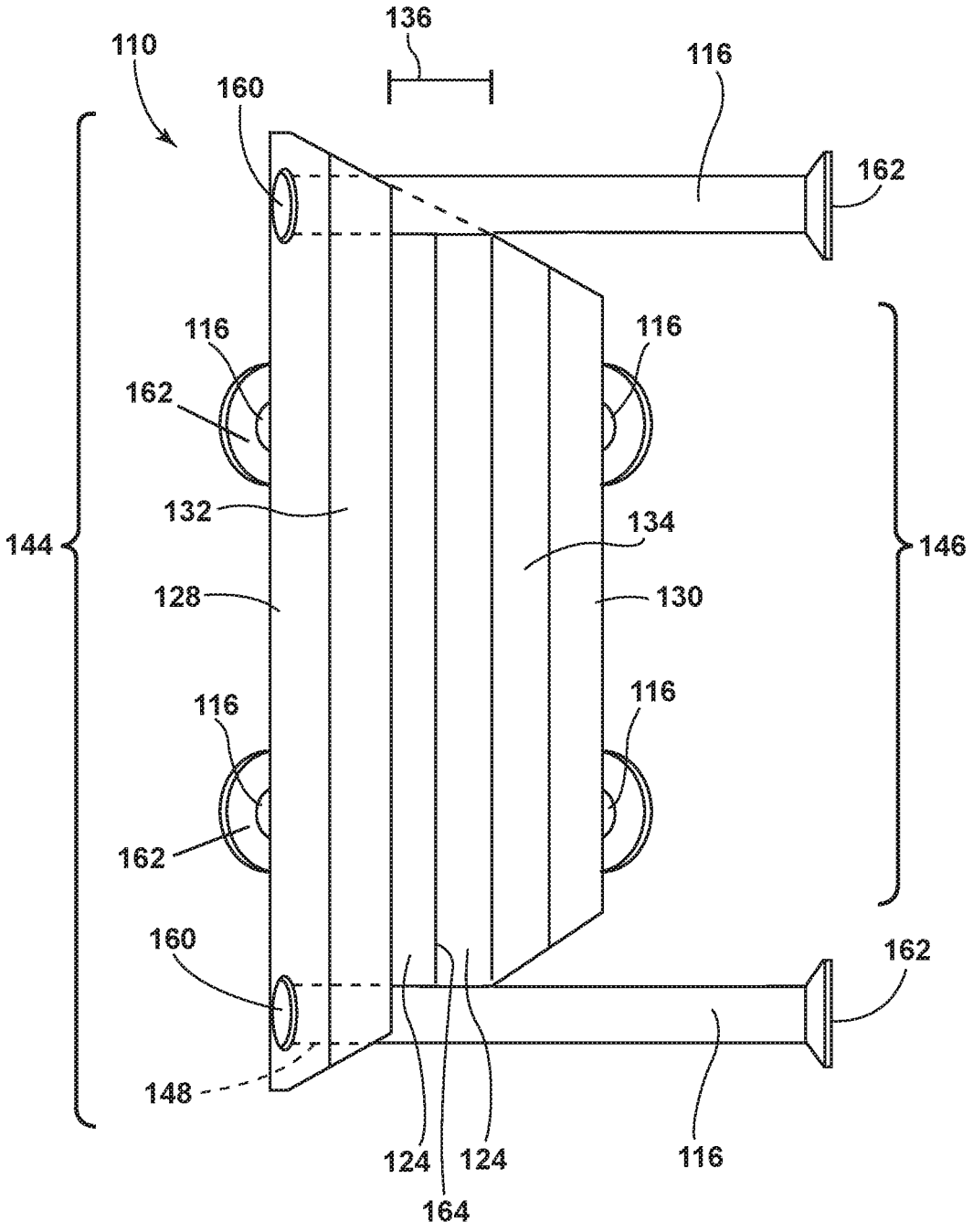
FIG. 7 is a top view of the anchor of FIG. 6.

Referring now to FIG. 7, a top view of the anchor 110 best illustrates the position of the bolts 116 extending through the first sidewall 128 and the gap 136 between the flanges 132, 134. The top view of the anchor 110 can be a trapezoidal shape. In additional embodiments, the top view may embody curved, rounded, or abstract shapes in non-limiting examples.

Figure 8:
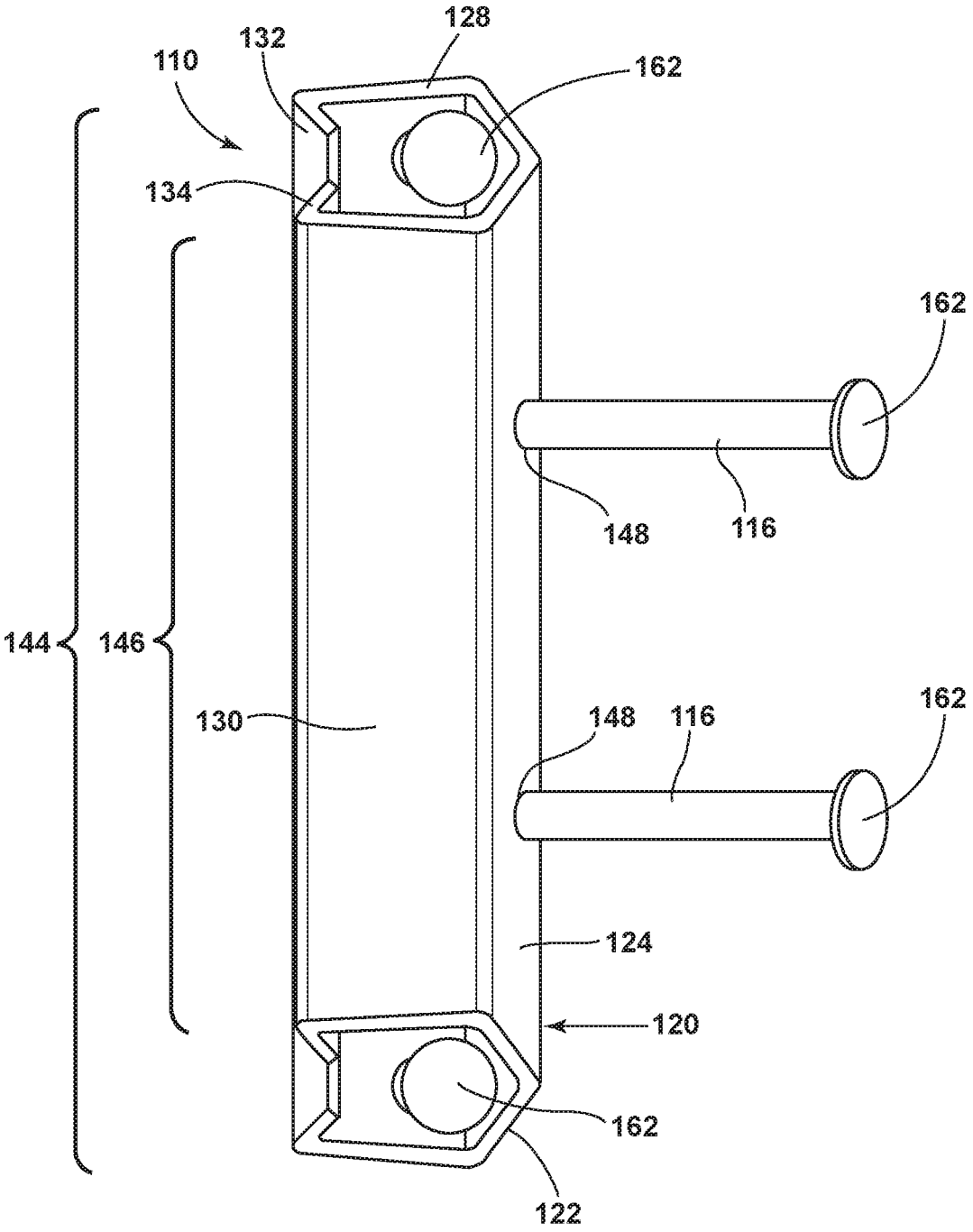
FIG. 8 is a left side view of the anchor of FIG. 7, illustrating the asymmetric disposition of the anchor.

The length of the combined first base wall 122, first sidewall 128, and the first flange 132 defines the first length 144 of a sufficient length to permit the installed bolts 116 to extend beyond the second sidewall 130 without contacting the second sidewall 130. As such, the first length 144 and the second length 146 can be variable, however, the second length 146 should be smaller than the first length 146 to provide room for the bolts 116. Referring briefly to FIG. 8, illustrating a side view of the anchor 110, the difference between the first and second lengths 144, 146 can be greater than the diameter of the foot 162 of the bolt 116. In an alternative example, where the anchor 110 does not include bolts 116 disposed in the sidewall 128, the lengths 144, 146 need not be limited by the spacing requirements to provide room for the extension of the bolts 116.

It should be understood that the use of the bolts 116 as illustrated is exemplary. More or less bolts 116 can be used that what is shown in differing positions as is desirable with the particular anchor 110 or with for the particular structure or implementation.

Figure 9:
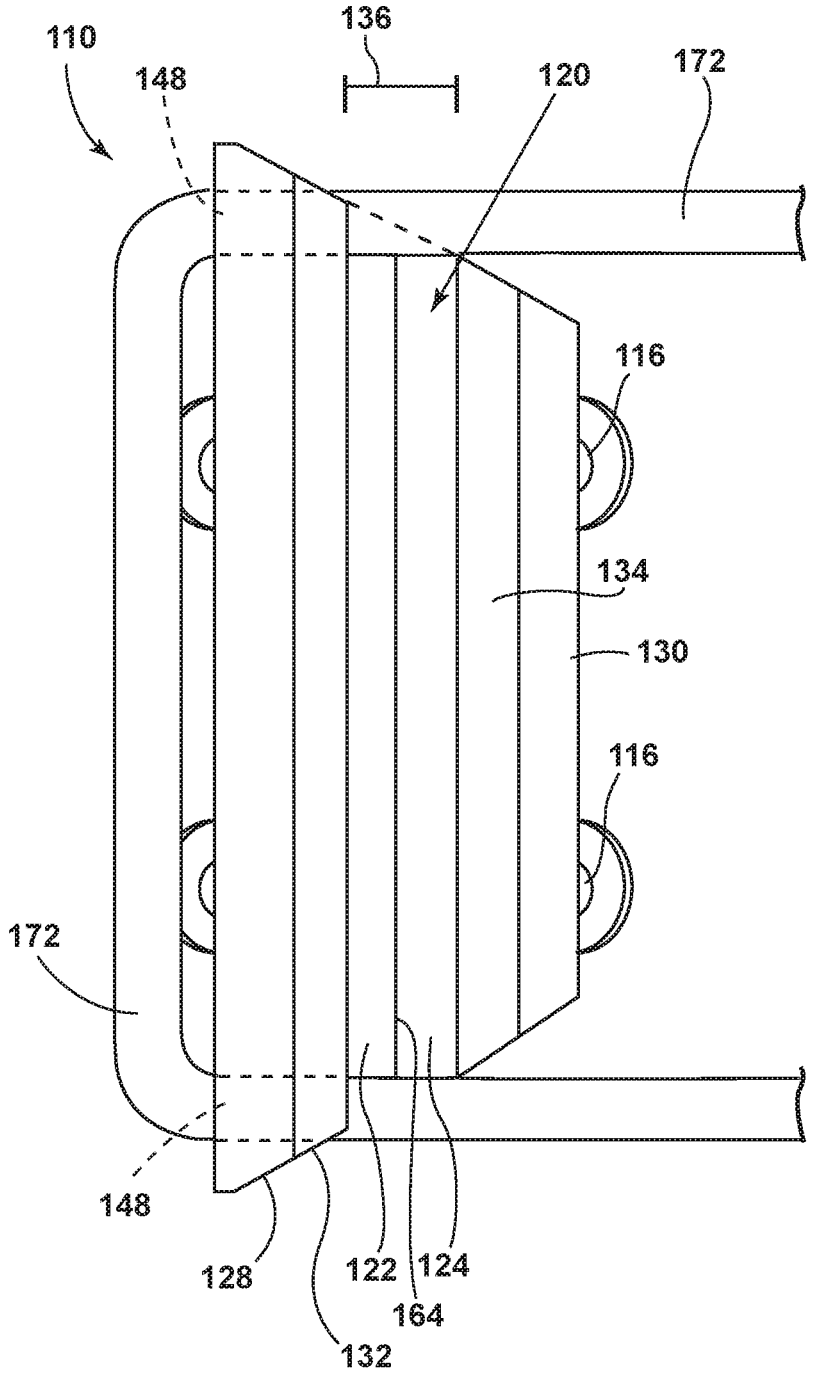
FIG. 9 is top view of the anchor of FIG. 8 illustration a variation on the bolts installed in the anchor.

Referring now to FIG. 9, an alternative use for the anchor 110 is illustrated having a wire strand 172 extending through the holes 148 in the first sidewall 128. As opposed to the bolts 116 disposed in the holes 148, the wire strand 172 or similar tensioning wiring can be run through the holes 148. It should be understood that the rebar 170 as shown is exemplary. Alternatively, in a first example, the rebar 170 can pass through the holes 148, into the interior 150, and extend external of the anchor 110 opposite from the second sidewall 130. In another example, separate lengths of rebar 170 can each extend through the individual holes 148 in the sidewall 128.

It should be further understood that the user of rebar can replace the bolts 16, 116 as shown and described herein, or can be a combination of bolts, rebar, or similar materials is contemplated.

This embodiment illustrated in FIGS. 5-9 enables additional methods of attaching construction materials or supporting the anchor with bolts 116 through the sidewalls 128, 130, while maintaining the benefits provided by the anchor 110. This embodiment allows for support of greater loads, while decreasing the incidence of bending, cracking, or shearing. Furthermore, the asymmetric anchor 110 provides for a wider range of uses for installing bolts 116, mounting components to the anchor 110, or supporting the anchor 110 with a length of wiring or rebar running through the anchor 110 in alternative positions.

Figure 10B:
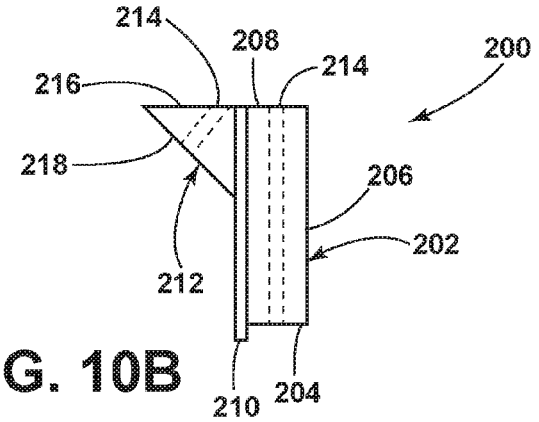
FIGS. 10A and 10B are views of a side cap for enclosing an end of the anchors of FIG. 1 or 5.
Figure 10A:
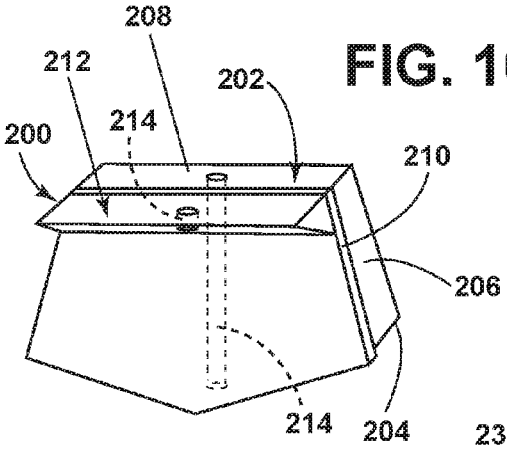
Figure 10C:
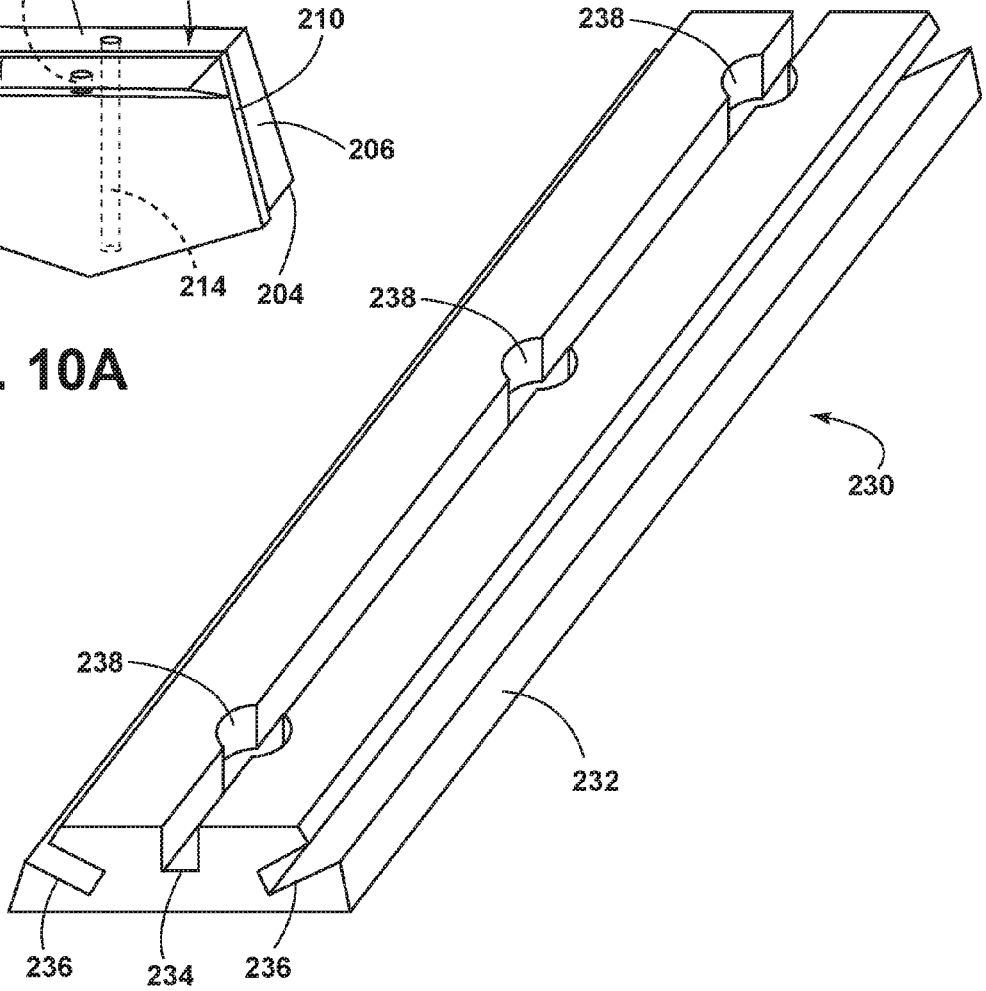
FIG. 10C is a top cap for enclosing the top of the anchors of FIG. 1 or 5.

Referring now to FIGS. 10A-10C, two different caps are illustrated for fluidly sealing the interior 60, 150 of the anchors 10, 110. FIG. 10A illustrates an end cap 200 for sealing the open ends of the anchors 10, 110. The end cap 200 includes body 202 having a v-shaped base wall 204, opposing sidewalls 206, and a top wall 208, complementary to the base wall, sidewalls, and flanges of the anchors 10, 110. The end cap 200 further includes a front plate 210, extending beyond the base wall 204. Alternatively, the front plate 210 can extend beyond the sidewalls 206 and the top wall 208. Referring now to FIG. 10B, the end cap 200 further includes an angled extension 212 having a top wall 216 and an angled wall 218, while non-angled extensions are contemplated. The extension 212 extends from the front plate 210. Both the body 202 and the extension 212 can include mounting holes 214. The mounting hole 214 in the body 202 extends from the top wall 208 to the base wall 204 and the mounting hole 214 in the extension extends from the top wall 216 to the angled wall 218.

The mounting holes 214 provide for attaching elements to the end cap 200, with fasteners such as nails. Additionally, the mounting holes 214 can serve as visual alignment features.

Referring now to FIG. 10C, a top cap 230 includes a body 232 having a central groove 234 and two side grooves 236 extending along the length of the body 232. Three circular recesses 238 are defined within the central groove 234. The side grooves 236 are shaped to slidably insert along the flanges 24, 132, 134 of the anchors 10, 110, such that a top portion 240 of the body 232 is adapted to fit in the gap 36, 136 to seal the interior 60, 150. The recesses 238 provide for alignment or facilitate insertion of fasteners through the top cap 230 during connection to the anchor 10, 110.

The caps 200, 230 can be made of any suitable material, such as plastic or composite materials. Such a material is suitable to prevent leakage of a liquid concrete mixture into the interior 60, 150 of the anchors 10, 100, while permitting cutting, puncturing, or removal for installation of the fastener 18 into the gap 36, 136.

Figure 11:
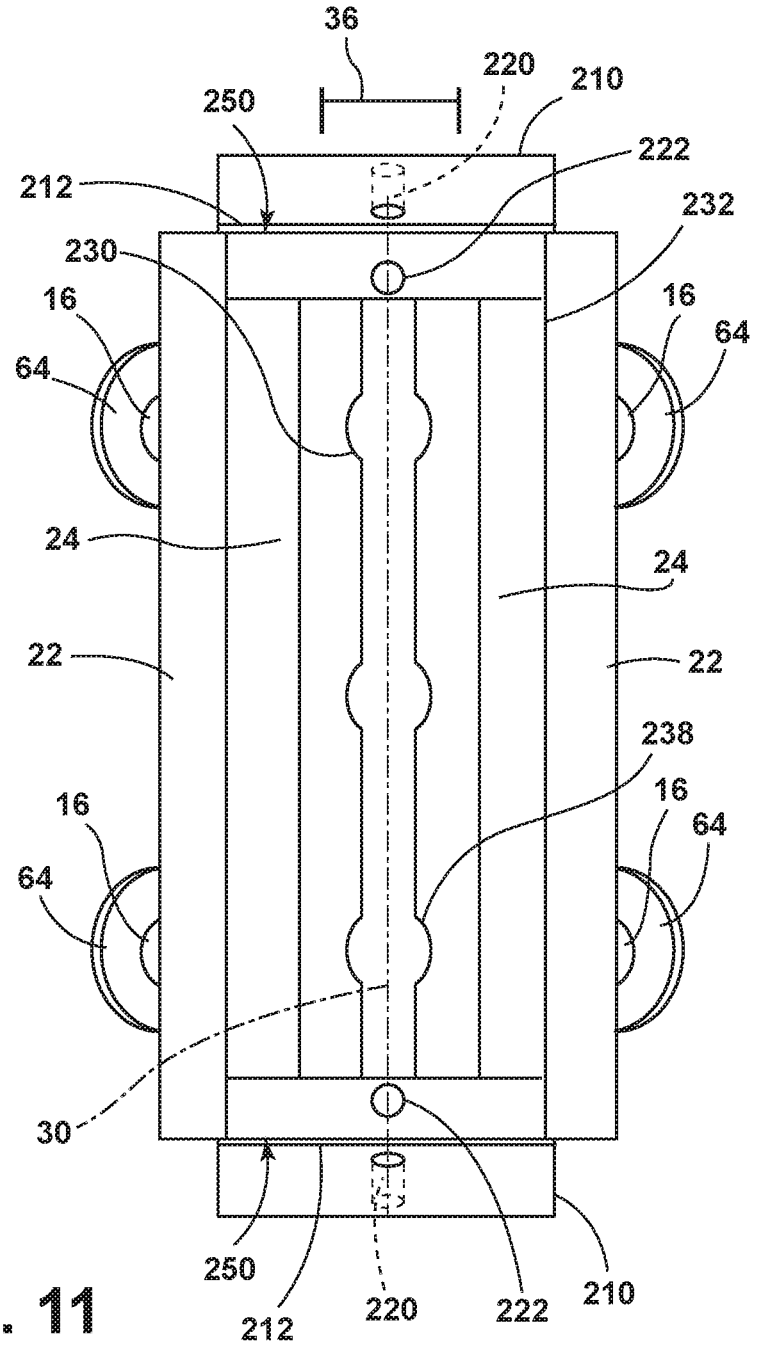
FIG. 11 is a top view of the anchor of FIG. 1 including the installed caps of FIGS. 10A-10C.

Referring now to FIG. 11, the anchor 10 of FIGS. 2-4 is illustrated having the end caps 200 and the top cap 230 installed in the anchor 10. The top cap 230 can slide into the gap 36, fitting the flanges 24 into the side grooves 236, sealing the interior at the gap 36. The end caps 200 are installed at opposing ends 250 of the anchor 10, having the body 202 disposed within the interior 60 and the extension 212 overhanging the ends 250 to seal the interior 60 at the ends 250. After installation of the top cap 230 and the side caps 200, the interior 60 of the anchor 10 is sealed, permitting the pouring of concrete around the anchor 10.

Figure 12:
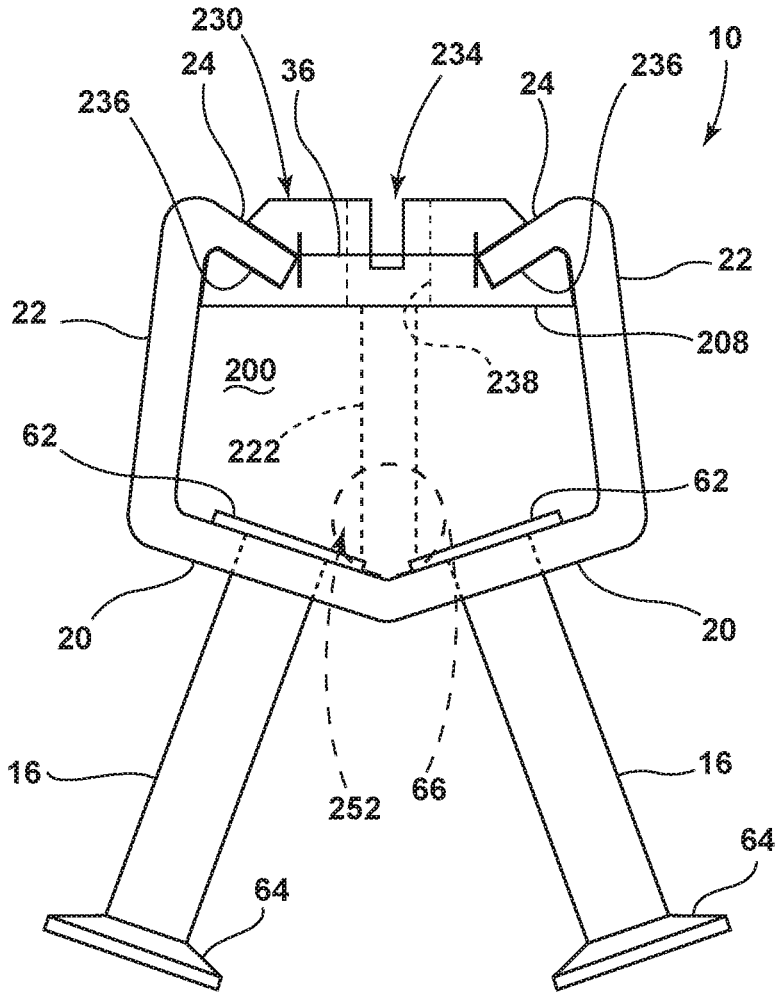
FIG. 12 is a side view of the anchor of FIG. 1 including the installed caps of FIGS. 10A-10C.

Referring to FIG. 12, in the case where a length of rebar 66 runs through the anchor 10, a rebar aperture 252 can be drilled or formed in the end caps 200 to permit the rebar 66 to extend through the anchor 10 while sealing the interior 60 during concrete pouring operations. As is best seen in FIG. 12, a bottom of the top cap 230 rests upon the top wall 208 of the end cap 200 to seal the interior 60 where the caps 200, 230 meet one another.

Figure 13:
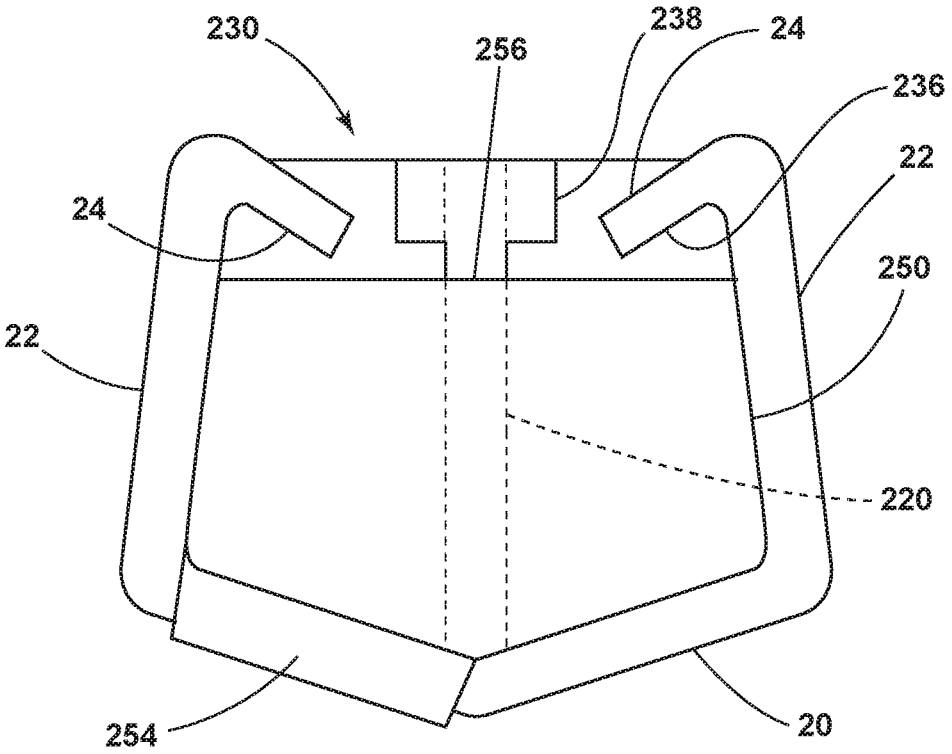
FIG. 13 is a side view of a variation on the side cap of FIGS. 10A and 10B installed within the anchor of FIG. 1 or 5.

FIG. 13 illustrates a variation of the end cap 200, and the top cap 230, including a tab 254 on the end cap 200 facilitating insertion or removal thereof by hand. The top cap 230 further includes an aperture 256 aligned with the mounting hole 214 of the end cap 200, as seen in the side view, for accepting the insertion of a fastener, such as a nail in one example, through both the top cap 230 and the end cap 200.

Figure 14:
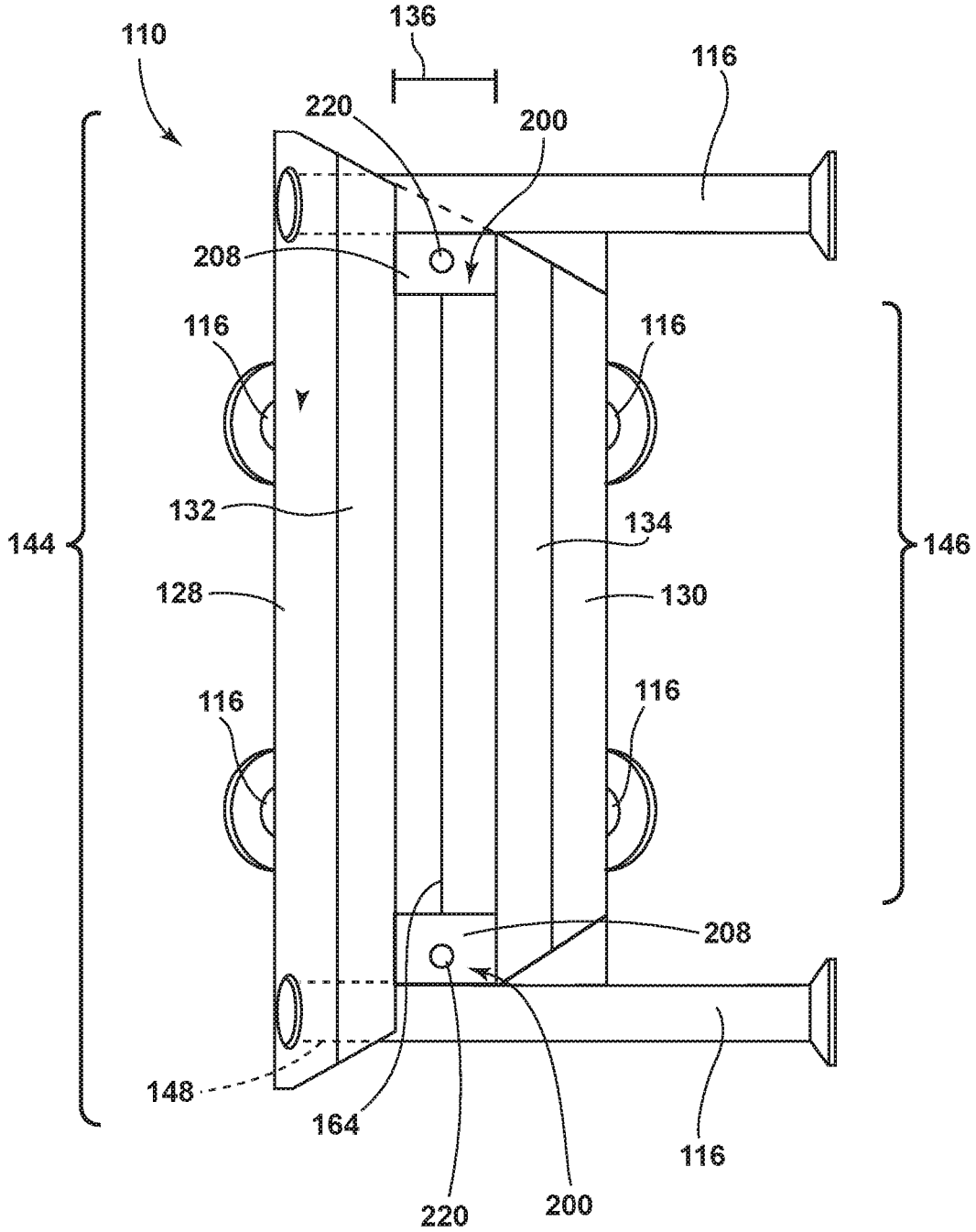
FIG. 14 is a top view of the anchors of FIG. 5 including the installed caps of FIGS. 10A-10C.

Referring now to FIG. 14, the anchor 110 of FIGS. 5-8 is illustrated including end caps 200 having the top cap 230 removed. The end caps 200 are disposed within the interior 150 of the anchor 110, between the opposing bolts 116 extending from the first sidewall 128. In this position, the interior 150 is sealed while permitting the extension of the bolts 116. A portion of the first base wall 122, the first sidewall 128, and the first flange 132 extends beyond the end caps 200, leaving a portion of the anchor 110 exposed during cementing operations.

In use, the cement cast 12 can be bounded for pouring concrete into a desired shape or depth. The concrete cast 12 can be an indeterminate size, used for cutting portions of the cast for particular use. Prior to pouring of a liquid concrete mixture, one or more anchors 10, 110 can be placed in the cast at desired locations where desirable. Alternatively, the liquid concrete mixture can be poured into the cast prior to adding the anchors 10, 110. After the liquid concrete is poured, the anchors 10, 110 can be placed in the liquid concrete at the desired positions.

After the concrete is poured and has set, the cast 12, or a cutting thereof, can be used in construction or masonry as desired. The caps 200, 230 can be cut, punctured, or removed from the anchor 10, 110 providing access to the interior 60, 150 for mounting a fastener 18 to the cast 12 at the anchor 10, 110. The fastener 18, such as a strap or bolt, can be inserted at the gap 36, 136 mounting to the anchor 10, 110 at the flanges 24, 132, 134. The fastener 18 can be used to mount other structural elements to the cast 12 at the anchor 10, 110.

It should be appreciated that the anchor 10, 110 as described herein provides for facilitating installation of an anchor 10, 110 within a concrete cast 12. Furthermore, the structural organization of the anchor 10, 110 provides for supporting a greater load as opposed to current anchors in the art. The widened angle on the bolts 16, 116 as installed on the angled walls of the anchor 10, 110 increases the load the bolts 16, 116 and anchor 10, 110 can support. The angled base walls, sidewalls, and flanges provide for minimized bending cracking, or shearing as is common with anchors 10, 110 utilizing tabs or non-angled walls. As such, the load that the anchor 10, 110 can support increases as well as the lifetime and durability of the anchor 10, 110, which can minimize overall maintenance, replacement, or servicing.

Furthermore, the asymmetric anchor 110 provides for utilizing additional bolts disposed in the sidewalls 128 which can further increase the load capabilities of the anchor 110. The angled disposition of the bolts in the sidewalls 128 minimizes bending, shearing, or cracking of the bolt 116 or the anchor 110 at which the bolt mounts, providing for increased lifetime and durability of the anchor 110. Further still, the asymmetric disposition of the anchor 110 supports a wider range of rebar or wire-support implementations while preserving the interior 150 of the anchor 110.

While the invention has been described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

What is claimed is:

1. A concrete mounting anchor comprising:

a base including two planar base walls intersecting one another at a vertical centerline to define a dividing line extending parallel to and between the two planar base walls on the vertical centerline, with the two planar base walls defining an obtuse angle between one another;

two sidewalls extending from the two planar base walls not parallel to the vertical centerline in the direction of the obtuse angle;

two flanges extending from the sidewalls toward the vertical centerline to define a gap between the two flanges; and at least one mounting bolt extending from each of the two planar base walls away from the vertical centerline;

wherein the orientation of the two planar base walls, the two sidewalls, the two flanges, and the mounting bolts provide load bearing capability when the concrete mounting anchor is cast in a concrete structure.

2. The concrete mounting anchor of claim 1 further comprising at least one aperture disposed in the planar base walls.

3. The concrete mounting anchor of claim 2 wherein the at least one mounting bolt is disposed within the at least one aperture.

4. The concrete mounting anchor of claim 3 wherein the at least one aperture includes four apertures.

5. The concrete mounting anchor of claim 4 wherein the at least one mounting bolt includes four mounting bolts.

6. The concrete mounting anchor of claim 3 wherein the four mounting bolts are tapped at one end to secure the bolts within the apertures.

7. The concrete mounting anchor of claim 1 wherein the two sidewalls are angled toward one another.

8. The concrete mounting anchor of claim 7 wherein the two flanges are angled toward the base.

9. The concrete mounting anchor of claim 8 wherein the two flanges have a thickness adapted to permit threaded insertion of a fastener.

10. A concrete mounting anchor comprising:

a base including a first base wall and a second base wall intersecting one another at a vertical centerline at an obtuse angle relative to each other to define a dividing line extending parallel to and between the first and second base walls, with the first base wall being longer along the dividing line than the second base wall;

first and second sidewalls extending from the first and second base walls, respectively, not parallel to the vertical centerline with the first sidewall being longer than the second sidewall in the direction of the dividing line;

first and second flanges extending from the first and second sidewalls, respectively, toward the vertical centerline to define a gap between the two flanges, with the first flange being longer than the second flange in the direction of the dividing line; and at least one mounting bolt extending away from the vertical centerline from one of the first and second base walls.

11. A concrete mounting anchor comprising:

a base including a first base wall and a second base wall intersecting one another at a vertical centerline at an obtuse angle relative to each other to define a dividing line extending parallel to and between the first and second base walls, with the first base wall being longer along the dividing line than the second base wall;

first and second sidewalls extending from the first and second base walls, respectively, not parallel to the vertical centerline with the first sidewall being longer than the second sidewall in the direction of the dividing line;

first and second flanges extending from the first and second sidewalls respectively, toward the vertical centerline to define a gap between the two flanges, with the first flange being longer than the second flange in the direction of the dividing line; and at least one mounting bolt extending from one of the first and second base walls and the from a portion of the first sidewall that is longer than the second sidewall.

12. The concrete mounting anchor of claim 11 wherein the first sidewall extends from the first base wall, the first flange extends from first sidewall, the second sidewall extends from the second base wall, and the second flange extends from the second sidewall.

13. The concrete mounting anchor of claim 12 wherein the concrete mounting anchor is asymmetric about the dividing line.

14. The concrete mounting anchor of claim 11 wherein the at least one mounting bolt extends toward the vertical centerline.

* * * * *